US005804537A

United States Patent [19]

Boffa et al.

[11] Patent Number: 5,804,537

[45] Date of Patent: Sep. 8, 1998

[54] CRANKCASE LUBRICANT COMPOSITIONS AND METHOD OF IMPROVING ENGINE DEPOSIT PERFORMANCE

[75] Inventors: Alexander Bowman Boffa, Glen Gardner; Thomas Richard Bidwell, Hightstown, both of N.J.

[73] Assignee: Exxon Chemical Patents, Inc., Linden, N.J.

[21] Appl. No.: 976,024

[22] Filed: Nov. 21, 1997

[51] Int. Cl.[6] ..... C10N 159/20

[52] U.S. Cl. ..... 508/398; 508/391; 508/460

[58] Field of Search ..... 508/391, 398, 508/460

[56] References Cited

U.S. PATENT DOCUMENTS

| | | | |
|---|---|---|---|
| 3,793,201 | 2/1974 | Karn | 508/398 |
| 4,283,294 | 8/1981 | Clarke | 508/398 |
| 5,071,576 | 12/1991 | Vernet et al. | 508/398 |
| 5,232,614 | 8/1993 | Colcborgh et al. | 508/375 |
| 5,256,322 | 10/1993 | Cohen | 508/398 |
| 5,328,620 | 7/1994 | Ripple | 508/391 |
| 5,726,133 | 3/1998 | Blakey et al. | 508/398 |

*Primary Examiner*—Jacqueline V. Howard
*Attorney, Agent, or Firm*—H. L. Cohen

[57] ABSTRACT

A low phosphorus passenger car motor oil containing an oil of lubricating viscosity as the major component and a tri-metal detergent mixture as a minor component, wherein the tri-metal detergent mixture comprises at least one calcium overbased metal detergent, at least one magnesium overbased metal detergent and at least one sodium overbased metal detergent, wherein the tri-metal detergent mixture is present in the oil composition in an amount such that the total TBN contributed to the oil composition by the tri-metal detergent mixture is from about 2 to about 12, and wherein the calcium overbased detergent contributes from about 8 to about 42% of the total TBN contributed by the tri-metal detergent mixture, the magnesium overbased detergent contributes from about 29 to about 60% of the total TBN contributed by the tri-metal detergent mixture, and the sodium overbased detergent contributes from about 15 to about 64% of the total TBN contributed by the tri-metal detergent mixture.

38 Claims, 2 Drawing Sheets

CRANKCASE LUBRICANT COMPOSITIONS AND METHOD OF IMPROVING ENGINE DEPOSIT PERFORMANCE

FIELD OF THE INVENTION

The present invention relates to crankcase lubricants, preferably low phosphorus crankcase lubricants, which contain a tri-metal mixture of detergents and which are characterized by unexpectedly superior engine deposit performance.

BACKGROUND OF THE INVENTION

In mid-1994, the American Automobile Manufacturers Association (AAMA) and the Japan Automobile Manufacturers Association (JAMA) jointly issued new minimum performance specifications for gasoline engine oils through the International Lubricants Standardization and Approval Committee (ILSAC). Included among the new specifications for ILSAC GF-2 oils were a number of ASTM Sequence engine tests, similar to those needed to satisfy API service categories, certain physical and chemical property requirements, and several new bench tests, including the Thermo-Oxidation Engine Oil Simulation Test (TEOST; TEOST is a registered trademark of Tannas Co.).

The TEOST was originally developed to evaluate the deposit formation tendencies of API SF quality engine oils brought in contact with very hot turbocharger components, and was included in GF-2 evaluation to probe the ability of a lubricant to control deposits in other high temperature areas of an engine. The TEOST, which is more fully described in SAE 932837, SAE 962038 and SAE 962039, is a high temperature deposit bench test which is performed by circulating a candidate oil through an oxidation reactor and a deposition zone made up of a depositor rod axially aligned with an outer tube. The temperature of the reactor and of the depositor rod are independently controlled.

The candidate oil to be evaluated (approximately 100 ml), along with iron naphthenate catalyst (100 ppm), is added to the oxidation reactor. The temperature of the mixture is raised and is maintained at 100° C., while it is contacted with a gas stream consisting of air, nitrous oxide ($N_2O$) and water. Throughout the test, the candidate oil is slowly pumped (at a rate of about 0.4–0.5 ml/min) through the annulus between the depositor rod and the outside casing, while the rod is cycled through a preset temperature program which regularly raises the rod temperature to 480° C. With the exception of the initial ramp to 200° C., the temperature of the rod is cycled from 200° C. to 480° C. approximately every 10 minutes. After running the test for 12 cycles (approximately two hours), the candidate oil is carefully collected and filtered through a pre-weighed filter to trap any insoluble material. The test equipment is then cleaned with a solvent and the used solvent is also collected and passed through the same filter previously used to filter the candidate oil. The filter is dried and weighed to determine the filter deposits. The depositor rod, which was weighed prior to initiation of the test, is dried and weighed to determine the weight of the deposits accumulated on the rod. The total deposits is the sum of the rod and filter deposits and is reported in milligrams (mg). The current ISLAC GF-2 pass/fail limit for the TEOST is a total deposit weight of 60 mg.

To meet the need for GF-2 crankcase lubricating oils, all of which must pass the TEOST and must perform adequately when used in a variety of engines under various operating conditions, a broad range of chemicals have been added to lubricating oil basestocks. Among such chemical additives are the overbased metal detergents, such as overbased alkali metal and overbased alkaline earth metal alkylaryl sulfonates, phenates, salicylates and other carboxylates, naphthenates, and the like. Overbased metal detergents function both as detergents and acid neutralizers, thereby reducing wear and corrosion and extending engine life. Overbased metal detergents are known to reduce the amount of engine deposits that are formed, as compared to comparable lubricating oils formulated without any metal detergents. Accordingly, it is typical to incorporate one or more metal detergents in a lubricating oil composition in amounts of from about 0.01 to about 10%, and preferably from about 0.1 to about 5%, by weight, based on the total weight of the oil composition, to achieve lubricating oil formulations which pass current GF-2 specifications.

There are numerous patents which disclose crankcase lubricants that contain overbased metal detergents. For example, U.S. Pat. No. 5,256,322 to Cohu relates to a lubricating oil for use in methanol fueled internal combustion engines, wherein the lubricating oil has a total base number (TBN) of from about 9.0 to about 14.0 and comprises a base oil and a combination of an overbased sodium sulfonate and at least one overbased metal sulfonate selected from the group of overbased calcium sulfonates, overbased magnesium sulfonates, and mixtures thereof. The overbased sodium sulfonate is present in the lubricating oil in an amount sufficient to provide a base number of from about 1.0 to about 2.0, and the overbased calcium sulfonates and/or overbased magnesium sulfonates are present in an amount sufficient to provide a base number of from about 8.0 to about 12.0. This patent teaches that the claimed combination of metal sulfonates is surprisingly effective in neutralizing carboxylic acids resulting from the combustion of methanol in internal combustion engines. This patent discloses the results of engine tests designed to determine the effects of alcohol fuels on engine wear. However, there is no disclosure as to the effects, if any, on engine deposit performance.

U.S. Pat. No. 5,232,614 to Colclough, et al. discloses lubricating oils incorporating substituted para-phenylene diamines as anti-oxidants to combat thickening and sludge formation after prolonged exposure to oxygen at elevated temperatures. In addition to the para-phenylene diamine anti-oxidant, the lubricating oils may contain a number of conventional additives, including overbased metal detergents. At column 11, lines 8–11 of this patent, a preference toward adding a combination of metal detergents to the lubricating oils is disclosed. However, no specific advantages of adding a combination of overbased metal detergents is disclosed; nor is there any discussion of engine deposit performance tests, nor of adding any particular combination of metal detergents in critical amounts.

EP Application 0 317 348 A1 (Exxon Chemical Patents, Inc.) discloses crankcase lubricating oil compositions for low temperature internal combustion engines. The compositions incorporate a mixture of at least one calcium overbased sulfonate or phenate and at least one magnesium overbased sulfonate or phenate. At page 6, lines 26–29 of this application it is disclosed that other alkaline earth and/or alkali metal detergents can be incorporated in the lubricating oil compositions. There are no engine deposit test results discussed in this application; nor is there any suggestion that a synergistic reduction of engine deposits might be achieved by using a particular tri-metal detergent combination. The main thrust of this application is the discovery of a surprisingly pronounced relationship between decreased cylinder and ring wear and the proportions of mixed calcium/magnesium detergent inhibitors and mixed primary/secondary zinc antiwear agent in crankcase oil compositions.

Despite all of the advances that have been made in the lubricating oil formulating art, a need remains for lubricating oils that exceed the current TEOST and other engine deposit performance requirements, without otherwise compromising oil performance.

SUMMARY OF THE INVENTION

Surprisingly, a lubricating oil composition capable of achieving significantly improved engine deposit performance can be formulated by incorporating into a passenger car motor oil (PCMO), preferably a low phosphorus PCMO (e.g., containing less than about 0.1 wt.% phosphorus), in amounts hereinafter set forth, a tri-metal detergent mixture of at least one overbased calcium-containing detergent, at least one overbased magnesium-containing detergent and at least one overbased sodium-containing detergent. It has been found that the present tri-metal detergent mixture results in unexpectedly superior engine deposit performance when compared to the results obtained when identical calcium-, magnesium- and sodium-containing detergents are incorporated in the lubricating oil composition either individually or in binary mixtures. The engine deposit performance of the present lubricating oil composition can be further improved by adding one or more neutral soaps to the composition.

The calcium-, magnesium-, and sodium-containing overbased detergents may comprise the respective metal salt of any oil soluble acid having a total base number (TBN) in excess of about 100 (mg KOH, as measured by ASTM D2896), typically in excess of about 200, and preferably in excess of about 300, e.g., 400. In one aspect of the invention, each of the calcium-, magnesium-, and sodium-containing overbased detergents comprises a metal sulfonate having a TBN in excess of 100. In another aspect, each of the calcium-, magnesium-, and sodium-containing overbased detergents comprises a metal phenate having a TBN in excess of 100. In yet another aspect, each of the calcium-, magnesium-, and sodium-containing overbased detergents comprises a metal carboxylate having a TBN in excess of 100. In still another aspect, at least one of the calcium-, magnesium- and/or sodium-containing overbased detergents comprises a metal sulfonate having a TBN in excess of 100, and at least one other of the calcium- magnesium- and/or sodium-containing overbased detergents comprises a metal phenate and/or carboxylate having a TBN is excess of 100. Typically, the neutral soaps which are added to the lubricating oil composition of this invention are metal sulfonates, phenates and/or carboxylates, e.g., calcium or sodium sulfonates, phenates or carboxylates, having a TBN of less than about 100, e.g., less than about 50, and preferably less than about 25.

The calcium-, magnesium- and sodium-containing overbased tri-metal detergent mixture is added to the lubricating oil composition such that the total TBN contributed to the fully formulated oil is from about 2 to about 10 mg KOH. Typically, the tri-metal overbased detergent mixture comprises from about 0.1 to about 10 wt.% of the fully formulated oil, and the relative amounts of the calcium, magnesium and sodium overbased detergents are such that the calcium overbased detergent contributes from about 8 to about 42% of the total TBN of the fully formulated oil, while the magnesium overbased detergent and the sodium overbased detergent contributes from about 29 to about 60% and from about 15 to about 64% of the total TBN, respectively.

DETAILED DESCRIPTION

Figure 1:
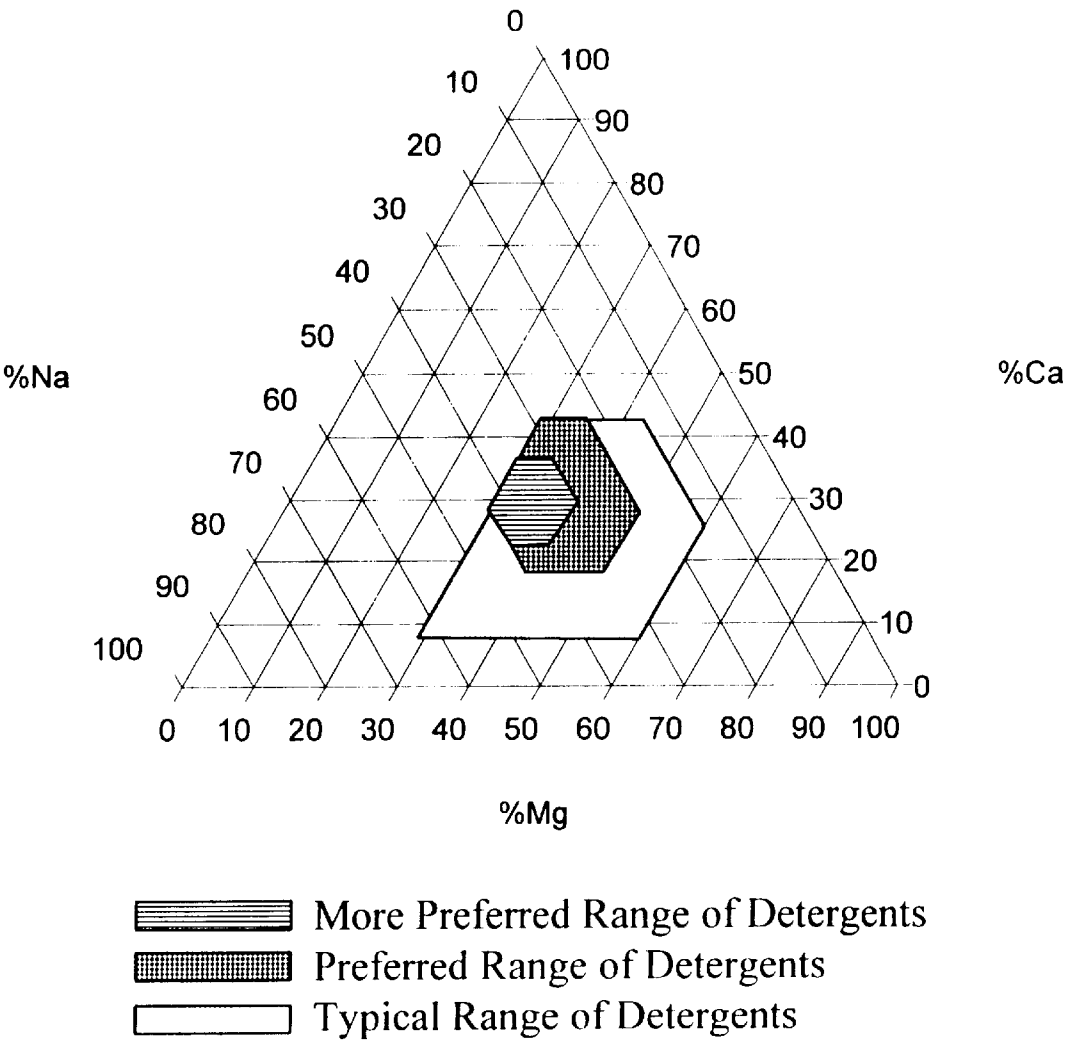
FIG. 1 is a triangular graph illustrating the typical and preferred percentages of the total TBN of the present lubricating oil compositions contributed by the calcium overbased detergent(s), magnesium overbased detergent(s) and sodium overbased detergent(s).

The lubricating oil composition of the present invention comprises a base oil of lubricating viscosity as the major component. The base oil may be selected from any of the synthetic or natural oils typically used as crankcase lubricating oils for spark-ignited and compression-ignited engines. The base oil conveniently has a viscosity of about 2.5 to about 12 cSt or $mm^2/s$ and preferably about 2.5 to about 9 cSt or $mm^2/s$ at 100° C. Mixtures of synthetic and natural base oils may be used if desired. Particularly useful base oils result in single grade and multigrade oils of 0W to 50W, including permutations and combinations thereof, e.g., 0W, 5W, 10W, 20W, etc., 0W20, 5W20, 10W30, 20W50, etc.

In addition to the base oil of lubricating viscosity, the present lubricating oil composition contains, as an essential component, a minor amount of a tri-metal mixture comprised of at least one calcium overbased detergent, at least one magnesium overbased detergent, and at least one sodium overbased detergent.

Typically, the calcium, magnesium and sodium overbased detergents are salts of an oil soluble acid having a total base number (TBN) in excess of 100, typically in excess of 200, and preferably in excess of 300, e.g., about 400.

Conveniently, the calcium, magnesium and sodium overbased detergents are salts of an oil soluble sulfonic acid which are produced by heating a mixture of an oil-soluble sulfonate or alkaryl sulfonic acid with an amount of a calcium, magnesium and/or sodium compound in excess of the amount required to completely neutralize any sulfonic acid present, and thereafter forming a dispersed carbonate complex by reacting the excess metal with carbon dioxide. The sulfonic acids typically are obtained by the sulfonation of alkyl substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from 3 to more than 30 carbon atoms. For example, haloparaffins, olefins obtained by dehydrogenation of paraffins, or polyolefins produced from ethylene or propylene are all suitable. The alkaryl sulfonates usually contain from about 9 to about 70 or more carbon atoms, preferably from about 16 to about 50 carbon atoms per alkyl substituted aromatic moiety.

The oil soluble sulfonates may be neutralized with calcium, magnesium and/or sodium compounds, e.g., oxides, hydroxides, alkoxides, carbonates, carboxylate, sulfides, hydrosulfides, nitrates, borates and ethers. The amount of calcium, magnesium and/or sodium compound that is used to neutralize the oil soluble sulfonate is chosen having regard to the desired TBN of the final product, but the amount typically ranges from about 100 to about 220 wt. %, preferably at least 125 wt. % of the oil soluble sulfonate being neutralized.

Various other preparations of alkali metal and alkaline earth metal overbased alkaryl sulfonates are disclosed, for example, in U.S. Pat. Nos. 3,150,088 and 3,150,089, wherein overbasing is accomplished by hydrolysis of an alkoxide-carbonate complex with the alkaryl sulfonate in a hydrocarbon solvent-diluent oil.

Preferred calcium, magnesium and sodium sulfonate detergents are alkyl aromatic sulfonates having a high TBN, as measured by ASTM D2896, ranging from about 300 to about 440. Typical overbased calcium alkyl aromatic sulfonates have a calcium sulfonate content ranging from about 30 to about 90 wt. % (A.I.). Typical overbased magnesium alkyl aromatic sulfonates have a magnesium sulfonate content ranging from about 5 to about 70 wt. % (A.I.). Typical overbased sodium alkyl aromatic sulfonates have a sodium sulfonate content ranging from about 5 to about 80 wt. % (A.I.). Typical values of metals concentration in overbased detergents are from about 5 to 20 wt. % in a diluted additive. Thus, at an active ingredient concentration of 55 wt. %, the concentration of metal in a detergent (undiluted) is from about 9 to about 37 wt. %.

Other overbased calcium, magnesium and/or sodium detergents which may be used in place of or in combination with the above-described salts of sulfonic acids include, for example, overbased phenates, sulfurized phenates, thiophosphonates, salicylates, methylene bridged salicylate-phenates and naphthenates and other oil-soluble carboxylates; provided, however, that there always is used a mixture of calcium overbased detergent, magnesium overbased detergent and sodium overbased detergent in the amounts disclosed herein.

Typically, the tri-metal overbased detergent mixture, i.e., the mixture of calcium overbased detergent, magnesium overbased detergent and sodium overbased detergent, is present in the lubricating oil composition in an amount such that the total TBN contributed to the fully formulated oil composition by the tri-metal overbased detergent mixture is from about 2 to about 12 mg KOH, e.g., from about 3 to about 9, and preferably from about 3.5 to about 8. Thus, when using overbased detergents having a TBN in excess of about 100, the amount of tri-metal overbased detergent mixture present in the lubricating oil composition typically is from about 0.1 to about 10 wt. % (A.I.), e.g., from about 0.3 to about 6 wt. % (A.I.), and preferably from about 0.1 to about 3 wt. % (A.I.), based on the total weight of the fully formulated lubricating oil composition. In still more preferred aspects, the mixture of calcium overbased detergent, magnesium overbased detergent and sodium overbased detergent is present in the lubricating oil composition in an amount of from about 0.6 to about 0.8 wt. %, e.g., about 0.65 wt. %.

The relative amounts of the calcium overbased detergent (s), magnesium overbased detergent(s) and sodium overbased detergent(s), and thus the percentage of the total TBN of the fully formulated lubricating oil composition contributed by the respective detergents, may vary depending in part on the particular detergents employed. However, the amounts of the various detergents are selected such that the calcium overbased detergent(s) typically contributes from about 8 to about 42%, and preferably from about 17 to about 42% of the total TBN contributed by the tri-metal detergent mixture. Most preferably, the calcium overbased detergent (s) contributes from about 22 to about 37% of the total TBN contributed by the tri-metal detergent mixture.

The magnesium overbased detergent(s) typically contributes from about 29 to about 60%, and preferably from about 29 to about 50% of the total TBN contributed by the tri-metal detergent mixture. Most preferably, the magnesium overbased detergent(s) contributes from about 29 to about 40% of the total TBN contributed by the tri-metal detergent mixture. Similarly, the sodium overbased detergent(s) typically contributes from about 15 to about 64%, and preferably from about 22 to about 43% of the total TBN contributed by the tri-metal detergent mixture. Most preferably, the sodium overbased detergent(s) contributes from about 30 to about 43% of the total TBN contributed by the tri-metal detergent mixture.

The relative amounts of the calcium overbased detergent (s), the magnesium overbased detergent(s) and sodium overbased detergent(s) will be more fully understood with reference to FIG. 1, wherein the percentage of the total TBN of a fully formulated oil composition contributed by a 400 TBN sodium alkylbenzene sulfonate is shown along the left-hand axis of the triangular graph, wherein the percentage of the total TBN contributed by a 400 TBN calcium alkylbenzene sulfonate is shown along the right-hand axis of the triangular graph, wherein the percentage of the total TBN contributed by a 400 TBN magnesium alkylbenzene sulfonate is shown along the bottom axis of the triangular graph, wherein typical contributions to the total TBN by the various detergents that are added to the present lubricating oil compositions fall within the largest of the shaded areas of the graph, wherein relatively preferred contributions to the total TBN by the various detergents fall within the second largest of the shaded areas of the graph, and wherein still more preferred contributions to the total TBN by the various detergents fall within the smallest of the shaded areas of the graph.

In preferred compositions, one or more neutral soaps, such as a neutral alkali metal or alkaline earth metal sulfonate, phenate, sulfurized phenate, thiophosphonate, salicylate and naphthenate or other oil-soluble carboxylate, is added to the lubricating oil composition to further improve engine deposit performance. Neutral soaps typically have a TBN less than about 100, preferably less than about 50, e.g., less than about 25, and contribute very little to the total TBN of the finished oil. Such neutral soaps are described, for example, in U.S. Pat. No. 5,232,614. Typically, when the neutral soaps are added to the fully formulated lubricating oil composition, they are added in an amount of from about 0.05 to about 5 wt. % (A.I.), e.g., from about 0.1 to about 3 wt. %, and preferably from about 0.2 to about 2 wt. %, based on the total weight of the fully formulated lubricating oil composition.

It has been observed that when a neutral soap is added to a candidate oil which already contains a tri-metal overbased detergent mixture, the engine deposit performance of the candidate oil improves in an additive sense; whereas when a tri-metal overbased detergent mixture is added to an otherwise conventional candidate oil, regardless of whether there is a further addition of a neutral soap, a synergistic improvement in the engine deposit performance of the candidate oil is observed.

In addition to the base lubricating oil and the tri-metal mixture of overbased detergents, which are essential components, and the neutral soap, which is a preferred component, the lubricating oil composition of this invention typically contains one or more or optional components, such as ashless nitrogen containing dispersants, ashless nitrogen containing dispersant viscosity modifiers, antiwear and antioxidant agents, supplemental dispersants, stabilizers, such as polyisobutenyl succinic acids and/or anhydrides having a mean average molecular weight of from about 400 to about 2500, friction modifiers, rust inhibitors, anti-foaming agents, demulsifiers, and pour point depressants, and the like.

In general, suitable ashless nitrogen containing dispersants comprises an oil solubilizing polymeric hydrocarbon backbone derivatized with nitrogen substituents that are capable of associating with polar particles to be dispersed. Typically, the dispersants comprise a nitrogen containing moiety attached to the polymer backbone, often via a bridging group, and may be selected from any of the well known oil soluble salts, amides, imides, amino-esters, and oxazolines of long chain hydrocarbon substituted mono- and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone is typically an olefin polymer, especially polymers comprising a major molar amount (i.e. greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g. polypropylene or polyisobutylene) or a copolymer of two or more of such olefins (e.g. copolymers of ethylene and an alpha-olefin such as propylene and butylene or copolymers of two different alpha-olefins). Other copolymers include those in which a minor molar amount of the copolymer monomers, e.g., 1 to 10 mole %, is a $C_3$ to $C_{22}$ non-conjugated diolefin (e.g., a copolymer of isobutylene and butadiene, or a copolymer of ethylene, propylene and 1,4-hexadiene or 5-ethylidene-2-norbornene).

Preferred olefin polymers include polybutenes and specifically polyisobutenes (PIB) or poly-n-butenes, such as may be prepared by polymerization of a $C_4$ refinery stream.

Suitable olefin polymers and copolymers may be prepared by cationic polymerization of hydrocarbon feedstreams, usually $C_3$–$C_5$, in the presence of a strong Lewis acid catalyst and a reaction promoter, usually an organoaluminum such as HCl or ethylaluminum dichloride. Tubular or stirred reactors may be used. Such polymerizations and catalysts are described, e.g., in U.S. Pat. No. 4,935,576. Fixed bed catalyst systems also may be used as disclosed, e.g., in U.S. Pat. No. 4,982,045. Most commonly, polyisobutylene polymers are derived from Raffinate I refinery feedstreams. Conventional Ziegler-Natta polymerization also may be employed to provide olefin polymers suitable for preparing dispersants and other additives.

The oil soluble polymeric hydrocarbon backbone usually will have a number average molecular weight (Mn) within the range of from about 300 to about 10,000. The Mn of the backbone is preferably within the range of 500 to 10,000, more preferably 700 to 5,000 where the use of the backbone is to prepare a component having the primary function of dispersancy. Olefin polymers which are particularly useful for preparing dispersants have a Mn within the range of from 1500 to 3000. Where the component is also intended to have a viscosity modification effect it is desirable to use higher molecular weight polymers, typically polymers having a Mn of from about 2,000 to about 20,000; and if the component is intended to function primarily as a viscosity modifier, polymers having a Mn of from 20,000 to 500,00 or greater should be used. The functionalized olefin polymers used to prepare dispersants preferably have approximately one terminal double bond per polymer chain.

The Mn for such polymers can be determined by several known techniques. A convenient method for such determination is by gel permeation chromatography (GPC), which additionally provides molecular weight distribution information, see W. W. Yau, J. J. Kirkland and D. D. Bly, "Modern Size Exclusion Liquid Chromatography", John Wiley and Sons, New York, 1979.

The oil soluble polymeric hydrocarbon backbone may be functionalized to incorporate a functional group into the backbone of the polymer, or as pendant groups from the polymer backbone. The functional group typically will be polar and contain one or more hetero atoms such as P, O, S, N, halogen, or boron. The functional group can be attached to a saturated hydrocarbon backbone via substitution reactions or to an olefinic portion via addition or cycloaddition reactions. Alternatively, the functional group can be incorporated into the polymer by oxidation or cleavage of a small portion of the end of the polymer (e.g., as in ozonolysis).

Useful functionalization reactions include, for example, halogenation of the polymer at an olefinic bond and subsequent reaction of the halogenated polymer with an ethylenically unsaturated functional compound; reaction of the polymer with an unsaturated functional compound by the "ene" reaction absent halogenation (e.g., maleation where the polymer is reacted with maleic acid or anhydride); reaction of the polymer with at least one phenol group (this permits derivatization in a Mannich Base-type condensation); reaction of the polymer at a point of unsaturation with carbon monoxide using a Koch-type reaction to introduce a carbonyl group in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil soluble polymeric hydrocarbon backbone is then further derivatized with a nucleophilic amine, amino-alcohol, or mixture thereof to form oil soluble salts, amides, imides, amino-esters, an oxazolines. Useful amine compounds include mono- and (preferably) polyamines, most preferably polyalkylene polyamines, of abut 2 to 60, preferably 2 to 40 (e.g. 3 to 20), total carbon atoms and about 1 to 12, preferably 3 to 12, and most preferably 3 to 9 nitrogen atoms in the molecule. These amines may be hydrocarbyl amines or may be predominantly hydrocarbyl amines in which the hydrocarbyl group includes other groups, and the like. Preferred amines are aliphatic saturated amines. Non-limiting examples of suitable amine compounds include: 1,2-diaminoethane; polyethylene amines such as diethylene triamine and tetraethylene pentamine; and polypropyleneamines such as 1,2-propylene diamine.

Other useful amine compounds include, for example, alicyclic diamines such as 1,4-di(aminomethyl) cyclohexane; heterocyclic nitrogen compounds such as imidazolines; polyoxyalkylene polyamines; polyamido and related amido-amines; and tris(hydroxymethyl)amino methane (THAM). Dendrimers, star-like amines, and comb-structure amines also may be used, as may mixtures of amine compounds such as those prepared by reaction of alkylene dihalides with ammonia.

A preferred group of nitrogen containing ashless dispersants includes those derived from polyisobutylene substituted with succinic anhydride groups and reacted with polyethylene amines (e.g., tetraethylene pentamine) or with aminoalcohols and, optionally, with additional reactants such as alcohols.

The nitrogen containing dispersant can be further post-treated by a variety of conventional post treatments such as boration as generally taught in U.S. Pat. Nos. 3,087,936 and 3,254,025. This is readily accomplished by treating an acyl nitrogen dispersant with a boron compound selected from the group consisting of boron oxide, boron halides, boron acids and esters of boron acids in an amount to provide from about 0.1 atomic proportion of boron for each atomic proportion of nitrogen of the acylated nitrogen composition to about 20 atomic proportions of boron for each atomic proportion of nitrogen of the acylated nitrogen composition.

Boration is readily carried out by adding from about 0.05 to 4, e.g. 1 to 3 wt. % (based on the weight of acyl nitrogen compound) of a boron compound, preferably boric acid, which is usually added as a slurry to the acyl nitrogen compound and heating with stirring at from about 135° C. to about 190° C., e.g., 140° to 170° C. for from 1 to 5 hours followed by nitrogen stripping.

Suitable viscosity modifiers (or viscosity index improvers) that may be added to the present lubricating oil composition include oil soluble polymers having a weight average molecular weight of from about 10,000 to 1,000,000, preferably 20,000 to 500,000, as determined by gel permeation chromatography or light scattering methods.

Representative examples of such polymers include polyisobutylene, copolymers of ethylene and propylene and higher alpha-olefins, polymethacrylates, methacrylate copolymers, polyalkylmethacrylates, copolymers of styrene and acrylic esters, copolymers of a vinyl compound and an unsaturated dicarboxylic acid, and partially hydrogenated copolymers of styrene/isoprene, styrene/butadiene, and isoprene/butadiene, as well as the partially hydrogenated homopolymers of butadiene and isoprene and copolymers of isoprene/divinylbenzene.

Viscosity modifiers that function as dispersant viscosity modifiers also may be used. Descriptions of how to make such dispersant viscosity modifiers are found, for example, in U.S. Pat. Nos. 4,089,794, 4,160,739, and 4,137,185. Other dispersant viscosity modifiers are copolymers of ethylene or propylene reacted or grafted with nitrogen compounds such as described in U.S. Pat. Nos. 4,068,056, 4,068,058, 4,146,489 and 4,149,984.

Antiwear and antioxidant agents which may be incorporated in the lubricating oil composition include, for example, dihydrocarbyl dithiophosphate metal salts, wherein the metal may be an alkali or alkaline earth metal, or zinc, aluminum, lead, tin, molybdenum, manganese, nickel or copper. The zinc salts are most commonly used in lubricating oil compositions in amounts of from about 0.1 to about 10, preferably about 0.2 to about 2 wt. %, based upon the total weight of the lubricating oil composition. The salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a zinc compound. The zinc dihydrocarbyl dithiophosphates can be made from mixed DDPA which in turn may be made from mixed alcohols. Alternatively, multiple zinc dihydrocarbyl dithiophosphates can be made and subsequently mixed.

Preferred zinc dihydrocarbyl dithiophosphates useful in the present invention are oil soluble salts of dihydrocarbyl dithiophosphoric acids wherein the hydrocarbyl moieties may be the same or different hydrocarbyl radicals containing from 1 to 18, preferably 2 to 12, carbon atoms and may comprise radicals such as alkyl, alkenyl, aryl, aralkyl, alkaryl and cycloaliphatic radicals. Particularly preferred hydrocarbyl radicals are alkyl groups of 2 to 8 carbon atoms, including, for example ethyl, n-propyl, n-butyl, i-butyl, amyl, n-hexyl, n-octyl, and 2-ethylhexyl. In order to obtain oil solubility, the total number of carbon atoms in the dithiophosphoric acid will generally be about 5 or greater. When used in the present composition, the amount of dihydrocarbyl dithiophosphate metal salt should be limited such that the fully formulated motor oil contains less than about 0.1 wt. % phosphorus, preferably less than about 0.08 wt. % phosphorus, and more preferably less than about 0.06 wt. % phosphorus.

Supplemental dispersants, i.e., dispersants that do not contain nitrogen, may be used. These nitrogen free dispersants may be esters made by reacting any of the functionalized oil soluble polymeric hydrocarbon backbones described above with hydroxy compounds such as monohydric and polyhydric alcohols or with aromatic compounds such as phenols and naphthols. Polyhydric alcohols are preferred, e.g. ethylene glycol or other alkylene glycols in which the alkylene radical contains from 2 to about 8 carbon atoms. Other useful polyhydric alcohols include glycerol, glycerol monostearate, pentaerythritol, dipentaerythritol, and mixtures thereof.

The ester dispersants also may be derived from unsaturated alcohols such as allyl alcohol. Still other classes of the alcohols capable of yielding nitrogen free ashless dispersants comprise ether-alcohols including, for example, oxy-alkylene and oxy-arylene-ether alcohols. They are exemplified by ether-alcohols having up to about 150 oxy-alkylene radicals in which the alkylene radical contains from 1 to 8 carbon atoms.

The ester dispersants may be prepared by one of several known methods as illustrated for example in U.S. Pat. No. 3,381,022. The ester dispersants also may be borated, similar to the nitrogen containing dispersants, as described above.

Oxidation inhibitors also may be included in the lubricating oil composition. Oxidation inhibitors reduce the tendency of mineral oils to deteriorate in service, which deterioration can be evidenced by the products of oxidation such as sludge and varnish-like deposits on engine surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, metal thiocarbamates, oil soluble copper compounds such as those described in U.S. Pat. No. 4,867,890, and molybdenum containing compounds such as molybdenum octoate (2-ethyl hexanoate), molybdenum dithiocarbamates, molybdenum dithiophosphates, oil-soluble molybdenum xanthates and thioxanthates, and oil-soluble molybdenum- and sulfur-containing complexes.

In one aspect of the invention the lubricating oil composition may include at least about 0.05 wt. % of a sulfurized alkyl phenol or hindered phenol antioxidant. Generally, hindered phenols are oil soluble phenols substituted at one or both ortho positions. Other or additional antioxidants which may be used in the present compositions are disclosed in U.S. Pat. No. 5,232,614.

Friction modifiers may be included in the lubricating oil composition to improve fuel economy. Among the well known friction modifiers which can be used are esters formed by reacting carboxylic acids and anhydrides with alkanols. Other conventional friction modifiers generally consist of a polar terminal group (e.g. carboxyl or hydroxyl) covalently bonded to an oleophilic hydrocarbon chain. Esters of carboxylic acids and anhydrides with alkanols are describe in U.S. Pat. Nos. 4,702,850 and 5,232,614. Examples of other conventional friction modifiers are described by M. Belzer in the "Journal of Tribology" (1992), Vol. 114, pp. 675–682 and M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used in the present lubricating oil composition.

Copper and lead bearing corrosion inhibitors may be used, but are typically not required with the composition of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,126, and 3,087,932 are typical. Other suitable corrosion inhibiting materials are disclosed in U.S. Pat. No. 5,232,614. When these compounds are included in the lubricating composition, they preferably are present in an amount not exceeding 0.2 wt % active ingredient.

Foam control can be provided by many compounds including an anitfoamant of the polysiloxane type, for example, silicone oil or polydimethyl siloxane.

A small amount of a demulsifying component may be used. A preferred demulsifying component can be obtained by reacting an alkylene oxide with an adduct obtained by reacting a bis-epoxide with a polyhydric alcohol (see, EP 330,522). The demulsifier should be used at a level not exceeding 0.1 wt. % (A.I.). A treat rate of 0.001 to 0.05 wt. % is convenient.

Pour point depressants, otherwise known as lube oil flow improvers, lower the minimum temperature at which the fluid will flow or can be poured. Such additives are well known. Typical of those additives which improve the low temperature fluidity of lubricating oil compositions are $C_8$ to $C_{18}$ dialkyl fumarate/vinyl acetate copolymers and polyalkylmethacrylates.

Some of the above-mentioned additives can provide a multiplicity of effects. For example, a single additive may act as a dispersant-oxidation inhibitor. This approach to lubricating oil formulating is well known and does not require further elaboration.

The various components may be incorporated into a base oil in any convenient way. For example, each of the components can be added directly to the oil by dispersing or dissolving it in the oil at the desired level of concentration. Such blending may occur at ambient temperature or at an elevated temperature.

Preferably all the additives except for the viscosity modifier and the pour point depressant are blended into a concentrate that is subsequently blended into basestock to make finished lubricant compositions. Use of such concentrates is conventional. The concentrate typically will be formulated to contain the additive(s) in proper amounts to provide the desired concentration in the final formulation when the concentrate is combined with a predetermined amount of base lubricating oil.

Preferably the concentrate is made in accordance with the method described in U.S. Pat. No. 4,938,880. That patent describes making a premix of ashless dispersant and metal detergents that is pre-blended at a temperature of at least about 100° C. Thereafter the pre-mix is cooled to at least 85° C. and the additional components are added. Such a concentrate typically comprises the following additives:

| ADDITIVE | Wt. % (A.I.) (Broad) | Wt. % (A.I.) (Preferred) |
|---|---|---|
| Nitrogen containing Ashless Dispersant(s) | 10–40 | 20-30 |
| Overbase calcium detergent | .05–20 | .1–12 |
| Overbase magnesium detergent | .05–20 | .1–12 |
| Overbase sodium detergent | .05–20 | .1–15 |
| Neutral soap detergent | 0–25 | .05–5 |
| Supplemental metal detergents | 0–20 | 1 |
| Corrosion inhibitor | 0–1 | 0 |
| Metal Dithiophosphate | 0–10 | 0–8 |
| Supplemental anti–oxidant | 0–40 | 0–30 |
| Anti-foaming agent | .005–.02 | .005–.01 |
| Supplemental anti-wear agents | 0–10 | 0.5 |
| Friction modifier | 0–10 | 0.5 |
| Demulsifier | 0–.1 | 0–.05 |
| Mineral or synthetic base oil | balance | balance |
| Included in the final formulation | | |
| Viscosity index improver | .01–6 | .01–4 |
| Pour point depressant | .01–5 | .01–1.5 |

The final formulations may employ from 3 to 50 wt. % and preferably about 4 to 20 wt. %, e.g., about 4 to 15 wt. % of the additive package(s) with the remainder being base oil. A preferred concentrate contains at least one ashless nitrogen containing dispersant, at least one calcium salt of an oil soluble acid having a TBN in excess of about 100, (preferably in excess of about 200, and more preferably in excess of about 300), at least one magnesium salt of an oil soluble acid having a TBN in excess of about 100 (preferably in excess of about 200, and preferably in excess of about 300), at least one sodium salt of an oil soluble acid having a TBN in excess of about 100 (preferably in excess of about 200, and preferably in excess of about 300), and at least one neutral soap.

The lubricating oil composition of this invention is capable of decreasing engine deposits to the extent that less than 30 mg total deposits are observed when the composition is tested in accordance with the Thermo-Oxidation Engine Oil Simulation Test (TEOST). Preferred compositions in accordance with this invention result in less than 20 mg total deposits, and typically less than 15 mg total deposits being observed. The compositions of this invention are particularly well suited for use as passenger car motor oils (PCMO's), and can be formulated in a variety of grades. Particularly useful are single grade and multigrade oils of 0W to 50W, including permutations and combinations thereof, e.g., 0W, 5W, 10W, 20W, etc., 0W20, 5W20, 10W30, 20W50, etc.

The invention is further described, by way of illustration only, in the following examples. Unless otherwise noted, all treat rates of all additives are reported as wt.% active ingredient.

Example 1

A series of crankcase lubricant formulations (candidate oils) were prepared by blending with a base oil of lubricating viscosity the additives set forth in Table 1. The various candidate oils were identical, except for the metal detergent component(s). The phosphorus content of each of the candidate oils was from about 0.09 to 0.1 wt. %, based on the weight of the fully formulated oils.

Each of the candidate oils was subjected to the Thermo-Oxidation Engine Oil Simulation Test (TEOST), as described in SAE 932837. During the approximately 2 hour test each candidate oil was circulated at a rate of 0.49 ml/min from a 116 ml reactor through the annulus of a depositor rod having a filled depositor volume of approximately 0.8 ml. The reactor was held at 100° C. during the entire test period, and the depositor rod was heated through 12 cycles according to the following program schedule:

| Program Step | Temperature | Time |
|---|---|---|
| 0 | Ramp to 200° C. | Immediate |
| 1 | Hold at 200° C. | 1 minute 15 sec |
| 2 | Ramp to 480° C. | 1 minute |
| 3 | Hold at 480° C. | 2 minutes |

-continued

| Program Step | Temperature | Time |
|---|---|---|
| 4 | Ramp to 200° C. | 4 minutes |
| 5 | Hold at 200° C. | 1 minute 15 sec |

Cycle 1 went through steps 0–5 once, cycles 2–12 went through steps 1–5 eleven times. Each cycle took 9.5 minutes and the total test time was 114 minutes.

The apparatus used for the TEOST included the reactor which held the candidate oil, a gear pump, a high temperature (depositor) zone, and a disc-type oil filter. Oil in the reactor was continuously stirred and the temperature was monitored by the thermocouple. The depositor rods were made of 1018 steel having a finely finished surface. The primary source of heat to the depositor rods and the candidate oil within the casing/rod annulus was low-voltage, high-amperage resistive heating applied to the ends of the depositor rods. The materials used for each test run were the candidate oil, 100 ppm iron naphthenate oxidation catalyst added to the candidate oil, air (flowed into the reactor at rate of 3.6 ml/min through water) and $N_2O$ (flowed into the reactor at a rate of 3.6 ml/min through water). After completion of each 12 cycle test run, the deposits that were formed on the depositor rod were weighed to within 0.1 mg. The deposits that were formed, but which did not adhere to the depositor rod, or which came loose during each test run, were trapped on the oil filter. The trapped filter deposits also were weighed to within 0.1 mg. For a given test run to pass the TEOST, the total weight of the collected deposits must be less than 60 mg. For each test run, the weight of the rod deposits, the weight of the filter deposits, and the total weight of the rod deposits plus the filter deposits are shown in Table 1.

| | Run No. Wt. % | | | | | | |
|---|---|---|---|---|---|---|---|
| Component | 1 | 2 | 3 | 4 | 5 | 6 | 7 |
| Mg sulphonate detergent[1] | 0.63 | 0 | 0 | 0.31 | 0.31 | 0 | 0.21 |
| Ca sulphonate detergent[2] | 0 | 0.63 | 0 | 0 | 0.31 | 0.31 | 0.21 |
| Na sulphonate detergent[3] | 0 | 0 | 0.63 | 0.31 | 0 | 0.31 | 0.21 |
| Dispersant[4] | 2.8 | 2.8 | 2.8 | 2.8 | 2.8 | 2.8 | 2.8 |
| Diluent oil | 10.61 | 10.61 | 10.61 | 10.61 | 10.61 | 10.61 | 10.61 |
| Neutral soap[5] | 0.14 | 0.14 | 0.14 | 0.14 | 0.14 | 0.14 | 0.14 |
| Silicone antifoamant | 0.002 | 0.002 | 0.002 | 0.002 | 0.002 | 0.002 | 0.002 |
| Friction modifier | 0.15 | 0.15 | 0.15 | 0.15 | 0.15 | 0.15 | 0.15 |
| Antioxidant | 0.85 | 0.85 | 0.85 | 0.85 | 0.85 | 0.85 | 0.85 |
| Zinc dialkyldithiophosphate | 0.86 | 0.86 | 0.86 | 0.86 | 0.86 | 0.86 | 0.86 |
| Pour point depressant | 0.08 | 0.08 | 0.08 | 0.08 | 0.08 | 0.08 | 0.08 |
| Demulsifier | 0.004 | 0.004 | 0.004 | 0.004 | 0.004 | 0.004 | 0.004 |
| Viscosity index improver | 0.5 | 0.5 | 0.5 | 0.5 | 0.5 | 0.5 | 0.5 |
| Mineral basestock | 82.65 | 82.65 | 82.65 | 82.65 | 82.65 | 82.65 | 82.65 |
| TEOST DEPOSITS (mg) | | | | | | | |
| Rod | 16.0 | 14.1 | 11.5 | 10.5 | 16.6 | 11.7 | 7.9 |
| Filter | 4.1 | 4.0 | 4.4 | 5.2 | 2.6 | 8.3 | 1.5 |
| Total | 20.1 | 18.1 | 15.9 | 15.7 | 19.2 | 20.0 | 9.4 |

[1] = 400 TBN Mg sulphonate
[2] = 400 TBN Ca sulphonate
[3] = 400 TBN Na sulphonate
[4] = Polyisobutenyl succinimide; PIB Mn = 2225;
[5] = 24 TBN soap As can be seen from the data in Table 1, all of the candidate oils resulted in less than 60 mg total deposits. Accordingly, all of the oils achieved acceptable (passing) TEOST results . However, it was found that the candidate oil containing the Mg-Ca-Na tri-metal detergent mixture (Run No. 7) resulted in by far the least rod deposits, by far the least filter deposits, and by far the least total deposits. When compared to the results observed for the candidate oils containing only one metal detergent (Run Nos. 1–3) or any bi- metal detergent mixture (Run Nos. 4–6), the vastly superior results observed for the tri-metal detergent mixture were quite unexpected.

Figure 2:
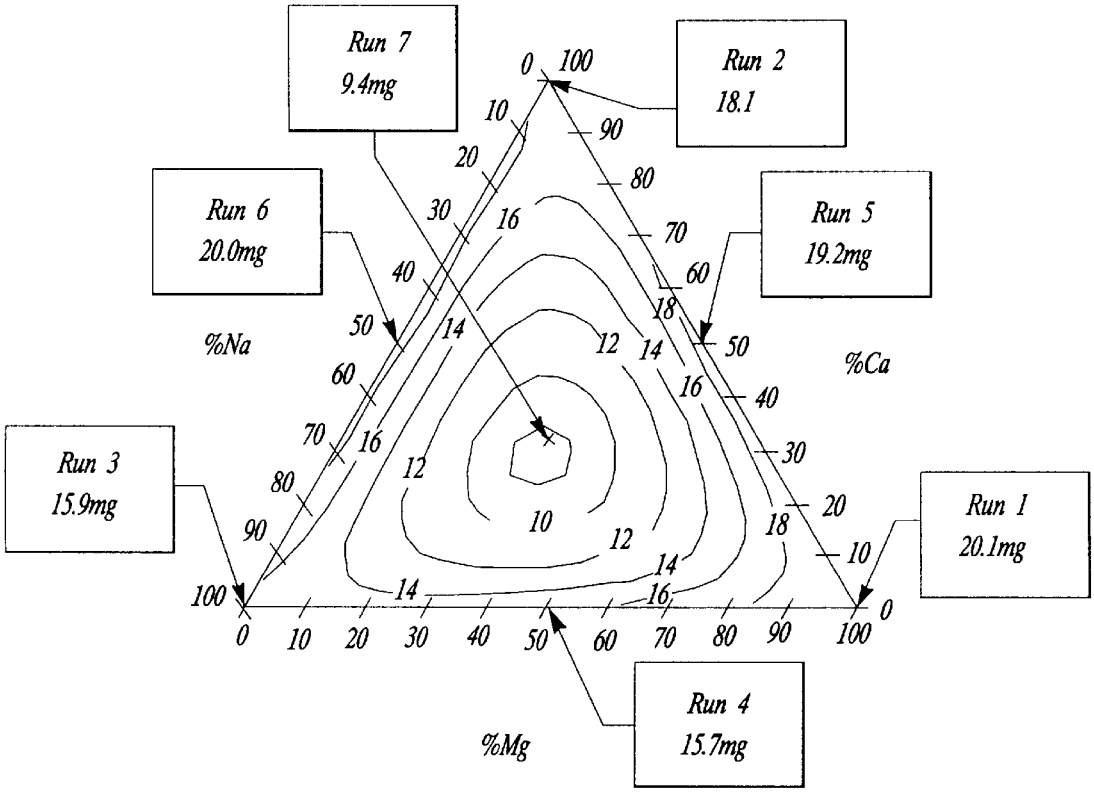
FIG. 2 is a triangular graph illustrating the total deposits collected after performing the Thermo-Oxidation Engine Oil Simulation Test (TEOST) in accordance with Example 1, wherein the various candidate oil compositions contained a combined total of 1.1 wt.% of 400 TBN overbased detergent (s), and wherein the percentages depicted in the graph represent the percentages of the total TBN of the various candidate oil compositions contributed by the respective overbased detergents

FIG. 2 illustrates the results of the various runs in Example 1 on a triangular graph, wherein the percentage of the total TBN of the lubricating oil composition contributed by the sodium overbased detergent is shown on the left-hand axis, the percentage of the total TBN contributed by the calcium overbased detergent is shown on the right-hand axis, and the percentage of the total TBN contributed by the magnesium overbased detergent is shown on the bottom axis. The numbers in each square on the graph represent the total deposits observed for that particular run.

Example 2

A crankcase lubricant formulation (candidate oil) was prepared by blending the additives set forth in Table 2 with a base oil of lubricating viscosity. The candidate oil was subjected to the CATERPILLAR 1M-PC test, which is used for determining the effects of lubricating oils on ring sticking, ring and cylinder wear and accumulation of piston deposits. The test method is designed to relate to high speed, supercharged diesel engine operation, and, in particular, to the detergency characteristics and anti-wear properties of diesel crankcase lubricating oils. The test operation involved the control of a supercharged, single-cylinder diesel test engine for a total of 120 hours at a fixed speed and fuel rate using the candidate oil as a lubricant. A one hour break-in period preceded the test. At the conclusion of the test, the piston, rings, and cylinder were examined, and the amount and nature of the piston deposits were noted. For a candidate oil to pass this test, the observed top groove fill (TGF) demerits must be less than 70 mg and the observed weighted total demerits (WTD) must be less than 240 mg. As shown in Table 2, the candidate oil resulted in an observed TGF of only 67 mg and an observed TWD of only 145 mg. Accordingly, the candidate oil passed the 1M-PC test.

TABLE 2

| Component | Wt % (A.I.) |
|---|---|
| Mg sulphonate detergent[1] | 0.21 |
| Ca sulphonate detergent[2] | 0.21 |
| Na sulphonate detergent[3] | 0.21 |
| Dispersant[4] | 2.88 |
| Diluent oil | 5.4 |
| Neutral soap[5] | 0.14 |
| Silicone antifoarnant | 0.002 |
| Friction modifier | 0.15 |
| Antioxidant | 0.85 |
| Zinc dialkyldithidphosphate | 0.86 |
| Pour point depressant | 0.09 |
| Demulsifier | 0.004 |
| Viscosity index improver | 0.54 |
| Mineral basestock | 88.45 |
| OBSERVED RESULTS | |
| TGF (<70 passes) | 67 |
| TWD (<240 passes) | 145 |

[1]400 TBN Mg sulphonate
[2]400 TBN Ca sulphonate
[3]400 TBN Na sulphonate
[4]Polyisobutenyl succinimide; PIB Mn = 2225;
[5]24 TBN soap Example 3

Three lubricating oil compositions were evaluated for valve train wear performance utilizing a 2.3 L inline 4 cylinder engine equipped an overhead cam sliding follower valve train. The oil compositions were identical, except that the first composition contained only a magnesium overbased detergent, the second contained only a calcium overbased detergent, and the third contained only a sodium overbased detergent. The results of the evaluation, which are set forth below in Table 3, demonstrate that the oil composition containing the magnesium overbased detergent resulted in improved wear performance.

TABLE 3

| Detergent Type | Valve Train Wear, mils. |
|---|---|
| Magnesium Overbased | 7.0 |
| Calcium Overbased | 8.5 |
| Sodium Overbased | 9.5 |

What is claimed is:

1. A lubricating oil composition, which comprises: (a) an oil of lubricating viscosity as the major component and (b) a tri-metal detergent mixture as a minor component, said tri-metal detergent mixture comprising at least one calcium overbased metal detergent, at least one magnesium overbased metal detergent and at least one sodium overbased metal detergent, said tri-metal detergent mixture being present in the oil composition in an amount such that the total TBN contributed to the oil composition by said tri-metal detergent mixture is from about 2 to about 12, said calcium overbased detergent contributing from about 8 to about 42% of the total TBN contributed by said tri-metal detergent mixture, said magnesium overbased detergent contributing from about 29 to about 60% of the total TBN contributed by said tri-metal detergent mixture, and said sodium overbased detergent contributing from about 15 to about 64% of the total TBN contributed by said tri-metal detergent mixture.

2. A lubrication oil composition in accordance with claim 1, wherein said calcium overbased detergent contributes from about 17 to about 42% of the total TBN contributed by said tri-metal detergent mixture, said magnesium overbased detergent contributes from about 29 to about 50% of the total TBN contributed by said tri-metal detergent mixture, and said sodium overbased detergent contributes from about 22 to about 43% of the total TBN contributed by said tri-metal detergent mixture.

3. A lubrication oil composition in accordance with claim 1, wherein said calcium overbased detergent contributes from about 22 to about 37% of the total TBN contributed by said tri-metal detergent mixture, said magnesium overbased detergent contributes from about 29 to about 40% of the total TBN contributed by said tri-metal detergent mixture, and said sodium overbased detergent contributes from about 30 to about 43% of the total TBN contributed by said tri-metal detergent mixture.

4. A lubricating oil composition in accordance with claim 1, which, when tested in the Thermo-Oxidation Engine Oil Simulation Test (TEOST), results in less than about 30 mg total deposits.

5. A lubricating oil composition in accordance with claim 2, which, when tested in the Thermo-Oxidation Engine Oil Simulation Test (TEOST), results in less than about 30 mg total deposits.

6. A lubrication oil composition in accordance with claim 3, which, when tested in the Thermo-Oxidation Engine Oil Simulation Test (TEOST), results in less than about 30 mg total deposits.

7. A lubrication oil composition in accordance with claim 6, which, when tested in the Thermo-Oxidation Engine Oil Simulation Test (TEOST), results in less than about 20 mg total deposits.

8. A lubrication oil composition in accordance with claim 6, which, when tested in the Thermo-Oxidation Engine Oil Simulation Test (TEOST), results in less than about 15 mg total deposits.

9. A lubrication oil composition in accordance with claim 1, which further comprises one or more neutral soaps.

10. A lubrication oil composition in accordance with claim 2, which further comprises one or more neutral soaps.

11. A lubrication oil composition in accordance with claim 3, which further comprises one or more neutral soaps.

12. A lubrication oil composition in accordance with claim 11, wherein said composition is suitable for use as a passenger car motor oil.

13. A lubrication oil composition in accordance with claim 11, wherein said composition is selected from the group consisting single grade and multigrade passenger car motor oils.

14. A lubricating oil composition in accordance with claim 1, wherein said tri-metal detergent mixture is present in the oil composition in an amount of from about 0.1 to about 10 wt. %, based on the total weight of the oil composition.

15. A lubricating oil composition in accordance with claim 1, wherein said tri-metal detergent mixture is present in the oil composition in an amount of from about 0.3 to about 6 wt. %, based on the total weight of the oil composition.

16. A lubricating oil composition in accordance with claim 1, wherein said tri-metal detergent mixture is present in the oil composition in an amount of from about 0.4 to about 3 wt. %, based on the total weight of the oil composition.

17. A lubricating oil composition in accordance with claim 1, wherein said tri-metal detergent mixture is present in the oil composition in an amount of from about 0.6 to about 0.8 wt. %, based on the total weight of the oil composition.

18. A lubricating oil composition in accordance with claim 2, wherein said tri-metal detergent mixture is present in the oil composition in an amount of from about 0.1 to about 10 wt. %, based on the total weight of the oil composition.

19. A lubricating oil composition in accordance with claim 2, wherein said tri-metal detergent mixture is present in the oil composition in an amount of from about 0.3 to about 6 wt. %, based on the total weight of the oil composition.

20. A lubricating oil composition in accordance with claim 2, wherein said tri-metal detergent mixture is present in the oil composition in an amount of from about 0.4 to about 3 wt. %, based on the total weight of the oil composition.

21. A lubricating oil composition in accordance with claim 2, wherein said tri-metal detergent mixture is present in the oil composition in an amount of from about 0.6 to about 0.8 wt. % , based on the total weight of the oil composition.

22. A lubricating oil composition in accordance with claim 3, wherein said tri-metal detergent mixture is present in the oil composition in an amount of from about 0.1 to about 10 wt. %, based on the total weight of the oil composition.

23. A lubrication oil composition in accordance with claim 3, wherein said tri-metal detergent mixture is present in the oil composition in an amount of from about 0.3 to about 6 wt. %, based on the total weight of the oil composition.

24. A lubricating oil composition in accordance with claim 3, wherein said tri-metal detergent mixture is present in the oil composition in an amount of from about 0.5 to about 3 wt. % , based on the total weight of the oil composition.

25. A lubrication oil composition in accordance with claim 3, wherein said tri-metal detergent mixture is present in the oil composition in an amount of from about 0.9 to about 1.2 wt. %, based on the total weight of the oil composition.

26. A lubrication oil composition in accordance with claim 12, wherein said composition contains less than about 0.1 wt. % phosphorus.

27. A lubrication oil composition in accordance with claim 13, wherein said composition contains less than about 0.1 wt. % phosphorus.

28. A lubrication oil composition in accordance with claim 14, wherein said composition contains less than about 0.1 wt. % phosphorus.

29. A lubrication oil composition in accordance with claim 1, wherein each of said calcium overbased detergent (s), said magnesium overbased detergent(s) and said sodium overbased detergent(s) has a TBN in excess of 200.

30. A lubrication oil composition in accordance with claim 1, wherein each of said calcium overbased detergent (s), said magnesium overbased detergent(s) and said sodium overbased detergent(s) has a TBN in excess of 300.

31. A lubrication oil composition in accordance with claim 30, wherein said tri-metal detergent mixture is present in the lubrication oil composition in an amount such that said tri-metal detergent mixture contributes a TBN of from about 3 to about 9 to the total TBN of the oil composition.

32. A lubrication oil composition in accordance with claim 30, wherein said tri-metal detergent mixture is present in the lubrication oil composition in an amount such that said tri-metal detergent mixture contributes a TBN of from about 3.5 to about 8 to the total TBN of the oil composition.

33. A lubrication oil composition in accordance with claim 31, wherein said calcium overbased detergent contributes from about 17 to about 42% of the total TBN contributed by said tri-metal detergent mixture, said magnesium overbased detergent contributes from about 29 to about 50% of the total TBN contributed by said tri-metal detergent mixture, and said sodium overbased detergent contributes from about 22 to about 43% of the total TBN contributed by said tri-metal detergent mixture.

34. A lubrication oil composition in accordance with claim 32, wherein said calcium overbased detergent contributes from about 22 to about 37% of the total TBN contributed by said tri-metal detergent mixture, said magnesium overbased detergent contributes from about 29 to about 40% of the total TBN contributed by said tri-metal detergent mixture, and said sodium overbased detergent contributes from about 30 to about 43% of the total TBN contributed by said tri-metal detergent mixture.

35. A lubrication oil composition in accordance with claim 1, wherein said tri-metal detergent mixture is present in the oil composition in an amount of about 0.6 to about 0.8 wt. %, based on the total weight of the oil composition, and wherein the amounts of calcium overbased detergent, magnesium overbased detergent and sodium overbased detergent comprising said tri-metal detergent mixture fall within the range encompassed within the smallest shaded area in FIG. 1.

36. A method of reducing the deposits which form in an internal combustion engine during the operation thereof due to deterioration of the crankcase lubricating oil that is used to lubricate the engine, which comprises using as the crankcase lubricating oil a composition which comprises an oil of lubricating viscosity as the major component and a tri-metal overbased detergent mixture of at least one calcium overbased metal detergent, at least one magnesium overbased metal detergent and at least one sodium overbased metal detergent as a minor component, wherein said tri-metal overbased detergent mixture is present in the crankcase lubricating oil composition in an amount such that the total TBN contributed to the oil composition by said tri-metal detergent mixture is from about 2 to about 12, said calcium overbased detergent contributing from about 8 to about 42% of the total TBN contributed by said tri-metal detergent mixture, said magnesium overbased detergent contributing from about 29 to about 60% of the total TBN contributed by said tri-metal detergent mixture, and said sodium overbased detergent contributing from about 15 to about 64% of the total TBN contributed by said tri-metal detergent mixture.

37. The method of claim 36, which comprises using as the crankcase lubricating oil a composition which contains at least one neutral soap in addition to said oil of lubricating viscosity and said tri-metal overbased detergent mixture.

38. The method of claim 36, wherein said tri-metal detergent mixture is present in the oil composition in an amount of about 0.6 to about 0.8 wt. %, based on the total weight of the oil composition, and wherein the amounts of calcium overbased detergent, magnesium overbased detergent and sodium overbased detergent comprising said tri-metal detergent mixture fail within the range encompassed within the smallest shaded area in FIG. 1.

* * * * *